US008944585B2

(12) United States Patent
Hirai et al.

(10) Patent No.: US 8,944,585 B2
(45) Date of Patent: Feb. 3, 2015

(54) PRINTING APPARATUS

(75) Inventors: Yasuyuki Hirai, Yokohama (JP); Kentaro Onuma, Yokohama (JP); Masaaki Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 451 days.

(21) Appl. No.: 13/090,305

(22) Filed: Apr. 20, 2011

(65) Prior Publication Data

US 2011/0261130 A1 Oct. 27, 2011

(30) Foreign Application Priority Data

Apr. 27, 2010 (JP) ..... 2010-102583

(51) Int. Cl.
*B41J 2/01* (2006.01)
*B41J 11/00* (2006.01)
*B41J 29/17* (2006.01)

(52) U.S. Cl.
CPC ..... *B41J 11/007* (2013.01); *B41J 29/17* (2013.01)
USPC ..... 347/104; 347/101

(58) Field of Classification Search
CPC .. B41J 2/04541; B41J 2/04543; B41J 2/0458; B41J 11/0065; B41J 11/007; B41J 11/42; B41J 13/103; B41J 29/38; B41J 29/393
USPC ..... 347/5, 9, 16, 19, 101–104; 400/617, 400/636
IPC ..... B41J 2/01
See application file for complete search history.

(56) References Cited

U.S. PATENT DOCUMENTS

| | | | | |
|---|---|---|---|---|
| 6,899,412 | B2 | 5/2005 | Hirai | |
| 6,913,339 | B2 | 7/2005 | Uchida et al. | |
| 2003/0095170 | A1 * | 5/2003 | Johnson | 347/104 |
| 2004/0046316 | A1 * | 3/2004 | Tsuzawa | 271/264 |
| 2005/0012800 | A1 * | 1/2005 | Ohashi | 347/104 |
| 2005/0212895 | A1 * | 9/2005 | Nishitani | 347/215 |
| 2005/0270355 | A1 * | 12/2005 | Sootome et al. | 347/104 |
| 2006/0033943 | A1 * | 2/2006 | Yanagi | 358/1.13 |
| 2006/0221166 | A1 * | 10/2006 | Inoue | 347/104 |
| 2006/0232624 | A1 * | 10/2006 | Inoue | 347/23 |
| 2007/0126838 | A1 * | 6/2007 | Tatsumi | 347/104 |

(Continued)

FOREIGN PATENT DOCUMENTS

| | | | |
|---|---|---|---|
| JP | 2004-137033 | A | 5/2004 |
| JP | 2007-069438 | A | 3/2007 |

*Primary Examiner* — Manish S Shah
*Assistant Examiner* — Roger W Pisha, II
(74) *Attorney, Agent, or Firm* — Fitzpatrick, Cella, Harper & Scinto

(57) ABSTRACT

A printing apparatus is provided which can prevent foreign matters such as ink adhering to the surface of the conveying belt from getting transferred to other constitutional components. When the conveying belt is rotating in one direction, the foreign matters adhering to the surface of the conveying belt is removed by the wiper. When the conveying belt rotates a predetermined distance in the opposite direction, the pinch roller, the electric charge removing roller and the electric charge supply roller that are in contact with the belt surface are disengaged from the surface of the conveying belt. The predetermined distance is set equal to a rotating distance that the conveying belt rotates until a portion of the surface of the conveying belt, which was in contact with the wiper, comes into contact with the pinch roller, the electric charge removing roller and the electric charge supply roller.

15 Claims, 15 Drawing Sheets

(56) References Cited

U.S. PATENT DOCUMENTS

2008/0165242 A1* 7/2008 Hiroki et al. ..... 347/104
2009/0278301 A1* 11/2009 Hirai ..... 271/3.14
2009/0309942 A1* 12/2009 Sugiyama ..... 347/104
2010/0066794 A1* 3/2010 Kanazawa ..... 347/104

* cited by examiner

PRINTING APPARATUS

BACKGROUND OF THE INVENTION

1. Field of the Invention

The present invention relates to a printing apparatus that prints an image by applying ink onto a print medium carried by a conveying belt.

2. Description of the Related Art

There is a printing apparatus that performs a printing operation by using an inkjet print head to print on a print medium as it is conveyed by a conveying belt that attracts the print medium thereto by static electricity. In such a printing apparatus, there is a possibility that ink adhering to the surface of the conveying belt may be transferred to the back of a next sheet of the print medium.

Japanese Patent Laid-Open No. 2004-137033 discloses a method of clearing the conveying belt of adhering ink by using a belt cleaning unit, such as a blade, which can be brought into or out of contact with the surface of the conveying belt. Japanese Patent Laid-Open No. 2007-069438 discloses a method of cleaning the conveying belt, which, during a double-side print mode that prints both sides of a print medium, brings a belt cleaning roller into contact with the conveying belt when the print medium, after having been printed on its front surface, is inverted to have its back surface printed.

These prior art technologies, however, have the following drawbacks. In the cleaning method of Japanese Patent Laid-Open No. 2004-137033, when, after the print medium is printed on its front surface during the double-side print mode, the conveying belt is reversed to pull the print medium to a print position, the following problem may arise. That is, ink staying in a nipping portion between the cleaning blade and the conveying belt may move along with the conveying belt and be transferred to a roller that is in contact with the conveying belt. In the cleaning method of Japanese Patent Laid-Open No. 2007-069438, since the belt cleaning roller is made of a material with a higher ink absorbing capability than that of the conveying belt, the ink that was absorbed by the cleaning roller may get transferred back again to the conveying belt. Further, in a marginless printing that leaves no blank margin at the rear edge of the print medium, the ink that was ejected beyond the rear edge of the print medium onto the conveying belt can only be cleared after the print medium being transported leaves the conveying belt.

SUMMARY OF THE INVENTION

The present invention provides a printing apparatus that can prevent foreign matter, such as ink adhering to the surface of the conveying belt, from being transferred to other constitutional components.

In the first aspect of the present invention, there is provided a printing apparatus for printing an image on a print medium by ejecting ink onto the print medium conveyed by a conveying belt, the conveying belt being able to rotate in a first direction and in a second direction opposite the first direction, the printing apparatus comprising:

a first cleaning unit configured to remove a foreign matter from a surface of the conveying belt by coming into contact with the surface of the conveying belt when the conveying belt rotates in the first direction;

a component configured to be brought into or out of contact with the surface of the conveying belt; and a first activating unit configured to disengage the component from the surface of the conveying belt when the conveying belt rotates a first predetermined distance or more in the second direction;

wherein the first predetermined distance is a rotating distance that the conveying belt rotates in the second direction until a part of the surface of the conveying belt which was in contact with the first cleaning unit comes into contact with the component.

In the second aspect of the present invention, there is provided a printing apparatus comprising:

a conveying belt configured to convey a print medium;

a printing unit configured to execute a marginless printing that leaves no blank margin at at least one edge of the print medium by applying ink onto the print medium conveyed by the conveying belt in a first direction and onto a part of a surface of the conveying belt which is beyond the edge of the print medium;

a pinching member configured to cooperate with the conveying belt to nip the print medium conveyed by the conveying belt in the first direction;

an inverting unit configured to invert the print medium, conveyed by the conveying belt in a second direction opposite the first direction, upside down; and an activating unit configured to activate the pinching member to disengage it from the conveying belt if at least a part of the surface of the conveying belt moves past a position, where the pinching member was in contact with the conveying belt, as the print medium is conveyed by the conveying belt in the second direction, the part being attached with the ink.

In the third aspect of the present invention, there is provided a printing apparatus comprising:

a conveying belt configured to convey a print medium;

a printing unit configured to execute a marginless printing that leaves no blank margin at at least one edge of the print medium by applying ink onto the print medium conveyed by the conveying belt in a first direction and onto a part of a surface of the conveying belt which is beyond the edge of the print medium;

a rotating member configured to rotate in contact with the surface of the conveying belt with which the print medium also contacts;

an inverting unit configured to invert the print medium, conveyed by the conveying belt in a second direction opposite the first direction, upside down; and an activating unit configured to activate the rotating member to disengage it from the conveying belt if at least a part of the surface of the conveying belt moves past a position, where the rotating member was in contact with the conveying belt, as the print medium is conveyed by the conveying belt in the second direction, the part being attached with the ink.

In the fourth aspect of the present invention, there is provided a printing apparatus comprising:

a conveying belt configured to convey a print medium;

a printing unit configured to execute a marginless printing that leaves no blank margin at at least one edge of the print medium by applying ink onto the print medium conveyed by the conveying belt in a first direction and onto a part of a surface of the conveying belt which is beyond the edge of the print medium;

a cleaning unit configured to remove a foreign matter from the conveying belt by coming into contact with the surface of the conveying belt with which the print medium also contacts;

an inverting unit configured to invert the print medium, conveyed by the conveying belt in a second direction opposite the first direction, upside down; and an activating unit configured to activate the cleaning unit to disengage it from the conveying belt if at least a part of the surface of the conveying belt moves past a position, where the cleaning unit was in contact with the conveying belt, as the print medium is conveyed by the conveying belt in the second direction, the part being attached with the ink.

In the fifth aspect of the present invention, there is provided a printing apparatus comprising:

a conveying belt configured to convey a print medium;

a printing unit configured to print on the print medium by applying ink onto the print medium conveyed by the conveying belt in a first direction;

a first cleaning unit configured to remove a foreign matter from the conveying belt by coming into contact with a surface of the conveying belt as it travels in the first direction;

a second cleaning unit configured to remove a foreign matter from the conveying belt by coming into contact with the surface of the conveying belt as it travels in a second direction opposite the first direction; and an activating unit configured to disengage the second cleaning unit from the conveying belt when the conveying belt travels in the first direction and, when the conveying belt travels in the second direction, disengage the first cleaning unit from the conveying belt.

With this invention, when the conveying belt rotates in a first direction, foreign matters adhering to the surface of the belt are removed by a cleaning member and, when the belt is calculated to rotate a predetermined distance in a second direction opposite the first direction, a component that is in contact with the surface of the belt is disengaged from it. The predetermined distance is set equal to a rotating distance that the conveying belt travels in the second direction until that portion of the surface of the belt which was in contact with the cleaning member comes into contact with the component. This prevents the foreign matters on the surface of the conveying belt from getting transferred to the component.

Further features of the present invention will become apparent from the following description of exemplary embodiments (with reference to the attached drawings).

DESCRIPTION OF THE EMBODIMENTS

Now, embodiments of this invention will be described by referring to accompanying drawings.

(First Embodiment)

Figure 1:
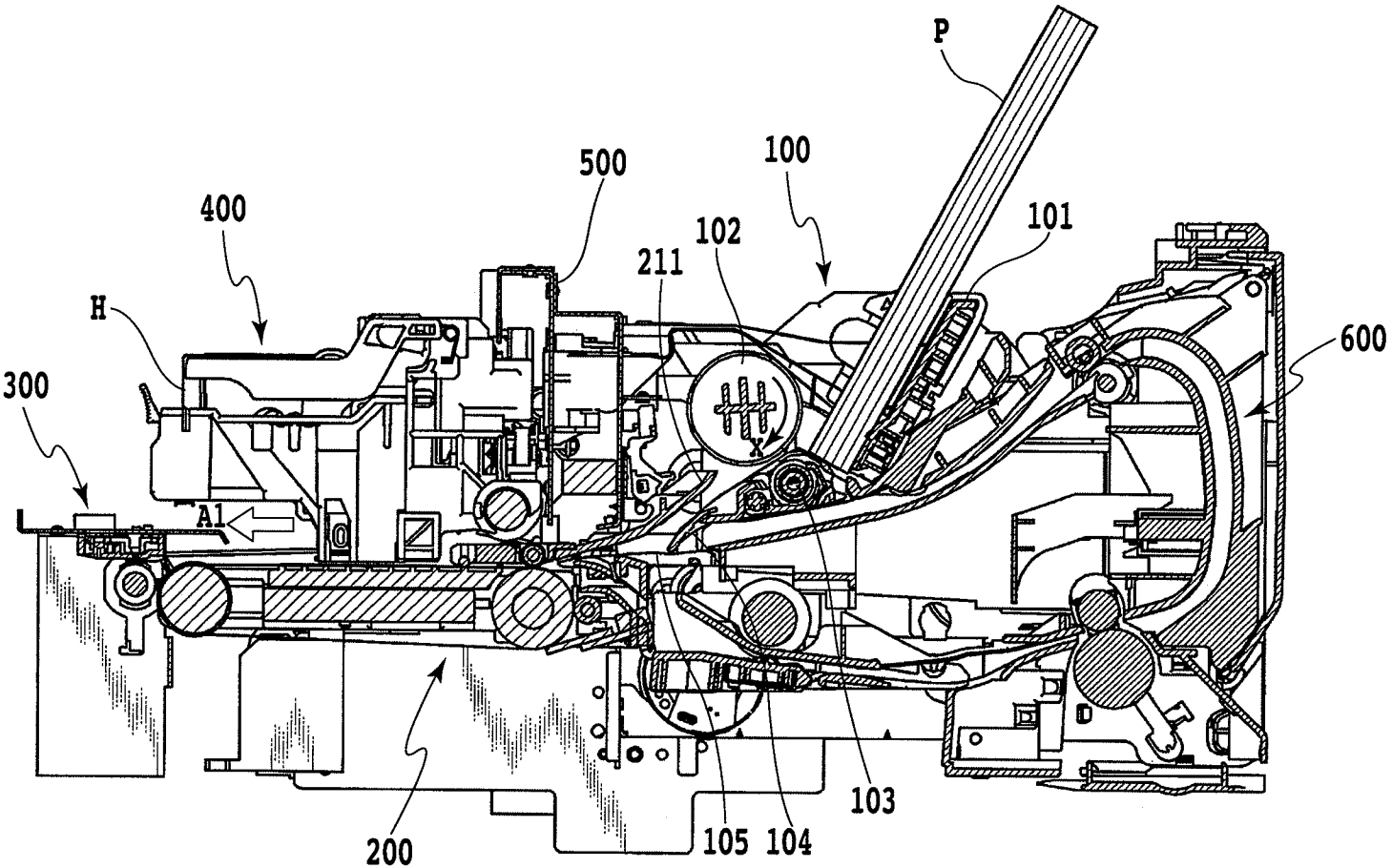
FIG. 1 is a schematic cross-sectional view of essential portions of a printing apparatus as a first embodiment of this invention.

FIG. 1 is a schematic cross-sectional view of the printing apparatus as the first embodiment of this invention.

In the printing apparatus of this embodiment, a sheet of print medium or paper P is fed by a paper feeding unit 100 to a paper conveying unit 200, from which it is further transported through a printing region in a direction of arrow A1 (sub-scan direction). A paper discharging unit 300 is situated downstream of the paper conveying unit 200 in the paper transport direction and discharges the printed sheet P out of the printing apparatus. A carriage unit 400 scans a print head H in a main scan direction crossing the paper transport direction (at right angles in this example). A paper inverting unit 600 inverts the sheet P to print images on both sides of the sheet P.

A variety of types of the print head H may be used that can print images by applying ink onto the sheet P. In this example, an inkjet print head capable of ejecting ink is used. The inkjet print head may use electrothermal conversion elements (heaters) and piezoelectric elements as ink ejection energy generation elements. Where the electrothermal conversion elements are used, the thermal energy generated by these elements is used to eject ink from ink ejection openings.

The paper feeding unit 100 is driven by a feed motor (not shown). As the feed motor rotates, a pressure plate 101 on which print paper sheets P are stacked is raised, bringing the sheets P into contact with a feed roller 102. The feed roller 102, as it rotates in a direction of arrow X, separates the uppermost one of the sheets P stacked on the pressure plate 101 by a coordinated action of a separation unit 103 that engages the feed roller 102. The separated sheet P is then fed to the paper conveying unit 200 as it is guided by paper guides 104, 105 and a pinch roller holder 211.

Figure 2:
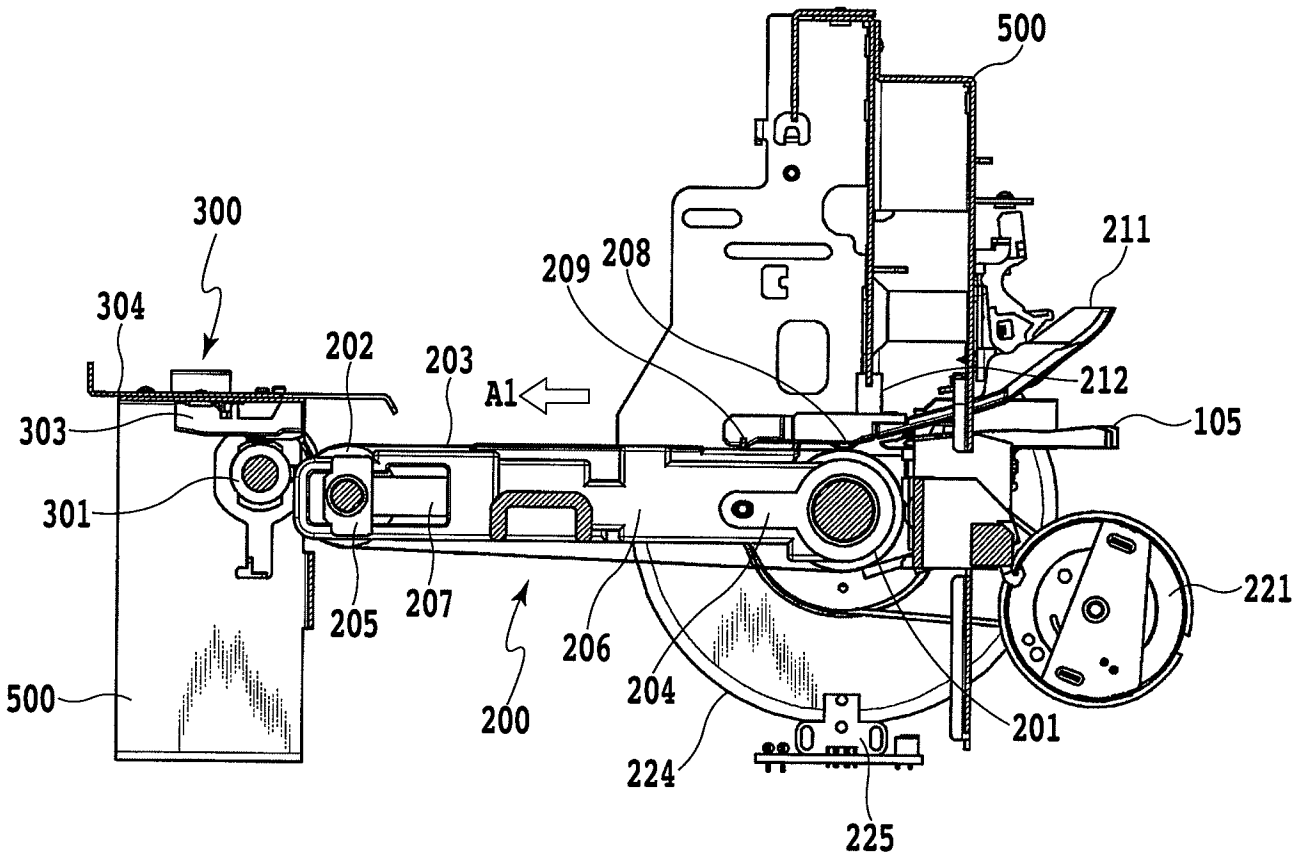
FIG. 2 is a schematic cross sectional view of a paper conveying unit and a paper discharging unit in the printing apparatus of FIG. 1.
Figure 3:
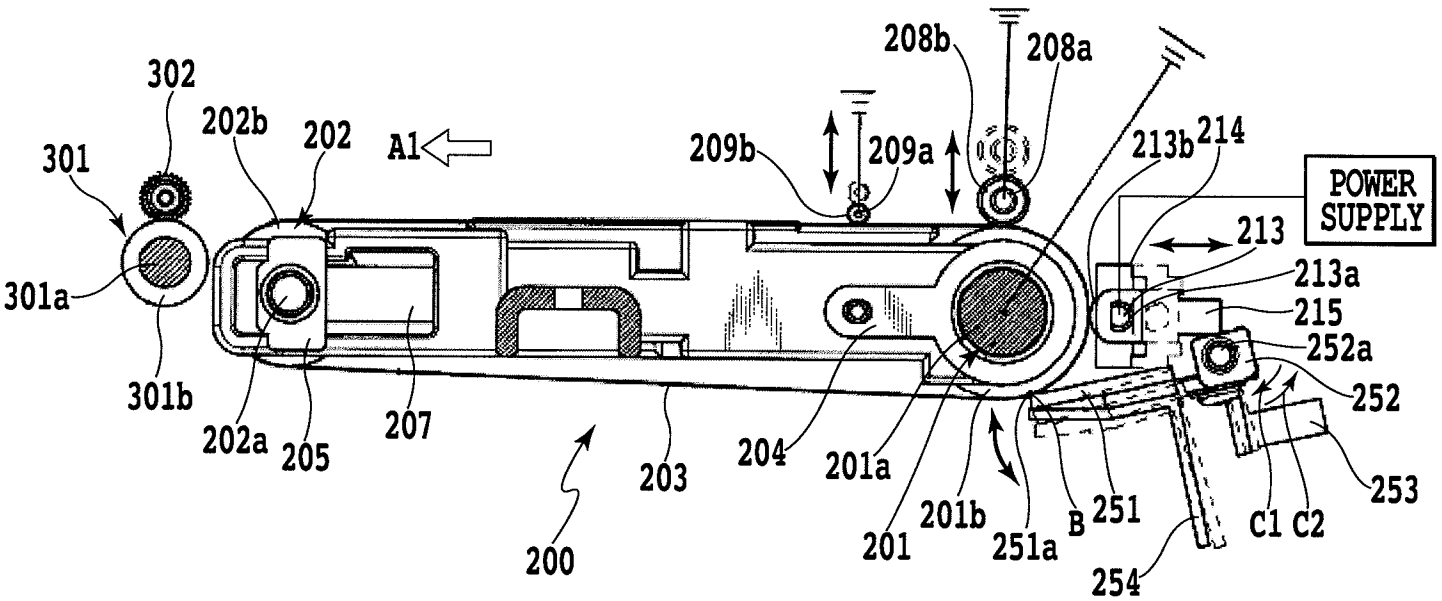
FIG. 3 is a schematic cross-sectional view of the paper conveying unit in the printing apparatus of FIG. 1.

FIG. 2 is a schematic cross-sectional view of the paper conveying unit 200 and the paper discharging unit 300. FIG. 3 is a schematic cross-sectional view of the paper conveying unit 200.

In the paper conveying unit 200, a conveying belt 203 is wound around a drive roller 201 and a follower roller 202 opposing each other. The drive roller 201 and the follower roller 202 are supported on a platen 206 through a drive roller bearing 204 and a follower roller bearing 205, respectively. The follower roller 202 is urged by a follower roller spring 207, which is a compression spring, through the follower roller bearing 205 in a direction that tenses the conveying belt 203. Above the drive roller 201 is provided a pinch roller 208 that presses the sheet P against the conveying belt 203 as it is rotated by the moving conveying belt 203. Downstream of the pinch roller 208 in the paper transport direction for printing is provided an electric charge removing roller 209 that, during printing, removes electric charges on the upper surface of the sheet P and the surface of the conveying belt 203 as it is rotated by the traveling conveying belt 203.

Upstream of the drive roller 201 in the paper conveying direction for printing (on the right-hand side of the drive roller 201 in FIG. 3) is installed an electric charge supply roller 213 that opposes the drive roller 201 through the conveying belt 203 and, during printing, applies electric charges to the surface of the conveying belt 203. The electric charge supply roller 213 is pressed against the surface of the conveying belt 203 by an electric charge supply roller spring 215 through an electric charge supply roller bearing 214 as it is rotated by the moving conveying belt 203. Upstream of the electric charge supply roller 213 in the paper conveying direction for printing (below the drive roller 201 in FIG. 3) is installed a wiper 251 (first cleaning unit) that opposes the drive roller 201 with the conveying belt 203 in between. The wiper 251 can be brought into contact with the surface of the conveying belt 203 to remove ink, dirt or foreign matters from its surface.

The pinch roller 208, the electric charge removing roller 209, the electric charge supply roller 213 and the wiper 251 can be brought into or out of contact with the conveying belt 203 by a cam or the like (not shown) connected to a drive source (not shown).

The drive roller 201 has a first roller portion 201*a* formed of a metal material and a second roller portion 201*b* formed of an elastic material such as rubber. These roller portions 201*a*, 201*b* are staggered from each other in the direction of axis of the drive roller 201, with the first roller portion 201*a* formed smaller in diameter than the second roller portion 201*b*. For the rubber material that forms the second roller portion 201*b*, a conductive rubber of EPDM (ethylene-propylene trimer) may be used and its rubber hardness is preferably in a range of between 50° and 90°. The second roller portion 201*b* may also be formed of a metal pipe that is coated on its outer circumferential surface with a conductive EPDM or conductive urethane-based elastomer or conductive urethane paint to make a friction coefficient of its outer surface relatively high. The first roller portion 201*a* is grounded through a metal part (not shown). The follower roller 202 is made of a metal material and has a first roller portion 202*a* and a second roller portion 202*b*, with the first roller portion 202*a* formed smaller in diameter than the second roller portion 202*b*. For a reduced weight of the follower roller 202, the second roller portion 202*b* may be formed of a pipe.

The conveying belt 203 has a two-layer structure with its surface formed of an insulating layer and its back formed of a conductive layer. As the conveying belt 203, a single layer belt with a high resistance and a high dielectric constant may be used.

The pinch roller 208 and the electric charge removing roller 209 are supported on the pinch roller holder 211 formed of a conductive material which in turn is mounted on a chassis 500 made of a metal material. The chassis 500 is grounded through the inside of the printing apparatus. The pinch roller 208 has a first roller portion 208*a* formed of a metal material and a second roller portion 208*b* formed of an elastic material such as rubber. These roller portions 208*a*, 208*b* are staggered from each other in the axis direction of the pinch roller 208, with the first roller portion 208*a* formed smaller in diameter than the second roller portion 208*b*. For the rubber material that forms the second roller portion 208*b*, a conductive rubber of EPDM (ethylene-propylene trimer) may be used and its rubber hardness is preferably in a range of between 50° and 90°. The electric charge removing roller 209 is formed of a metal material and has a first roller portion 209*a* and a second roller portion 209*b*. These roller portions 209*a*, 209*b* are staggered from each other in the axis direction of the electric charge removing roller 209, with the first roller portion 209*a* formed smaller in diameter than the second roller portion 209*b*. The pinch roller 208 and the electric charge removing roller 209 may also be formed of a conductive plastic material. The pinch roller 208 and the electric charge removing roller 209 are pressed against the conveying belt 203 by a pinch roller spring 212 and an electric charge removing roller spring (not shown), respectively.

The electric charge supply roller 213 has a first roller portion 213*a* formed of a metallic material and a second roller portion 213*b* formed of a foamed material such as sponge. These roller portions 213*a*, 213*b* are staggered from each other in the axis direction of the electric charge supply roller 213, with the first roller portion 213*a* made smaller in diameter than the second roller portion 213*b*. The sponge material of the second roller portion 213*b* may include, for example, urethane, NBR, EPDM (ethylene-propylene trimer) and hydrin rubber. The first roller portion 213*a* is connected through a metal part (not shown) of a conductive material to a power supply that applies a voltage to the electric charge supply roller 213.

The wiper (first cleaning unit) 251 is formed of a resilient thin plate material, such as urethane rubber, plastic and elastomer, and mounted on a wiper holder 252. The wiper holder 252 is rotatable about a pivot center 252*a* in directions of arrows C1, C2 by a pivoting mechanism (second activating unit). A wiper spring 253 biases the wiper holder 252 in the direction of arrow C1 to press an edge portion 251*a* of the wiper 251 against the conveying belt 203. The edge portion 251*a* of the wiper 251 engages the outer surface of that portion of the conveying belt 203 which is supported at its inner surface by the second roller portion 201*b* of the drive roller 201. For its improved performance of removing ink, dirt and foreign matter from the conveying belt 203, the wiper 251 is preferably made to engage the conveying belt 203 in such an attitude that it resists the conveying belt moving in the paper conveying direction. At the engagement portion B between the wiper 251 and the conveying belt 203, the ink that has been blocked and collected by the wiper 251 accumulates as the conveying belt 203 rotates. To absorb and discharge the accumulated ink, a bridge member 254 is provided parallel to the wiper 251. The bridge member 254 leads the ink collected by the wiper 251 to an ink absorbing member (not shown). The bridge member 254 may be formed of, for example, a porous material.

The platen 206 has a plurality of ribs (not shown) extending in the paper conveying direction of arrow A1 and in a direction perpendicular to the paper conveying direction. The conveying belt 203 transports the sheet P in the direction of arrow A1 as it travels over the ribs (not shown) during the printing operation of the print head H. The position in height of the conveying belt 203 is defined by the upper surface of the ribs (not shown).

The paper discharging unit 300 has a discharging roller 301, a spur 302 rotated by the discharging roller 301, a spur holder 303 supporting the spur 302, and a spur stay 304 securing the spur holder 303 to the chassis 500. The discharging roller 301 has a first roller portion 301*a* formed of a metal material and a second roller portion 301*b* formed of an elastic material such as rubber. These roller portions 301*a*, 301*b* are staggered from each other in the axis direction of the discharging roller 301, with the first roller portion 301*a* made smaller in diameter than the second roller portion 301*b*. The rubber material of the second roller portion 301*b* may include, for example, EPDM (ethylene-propylene trimer) and its rubber hardness is preferably in a range of between 50° and 90°. The second roller portion 301*b* may also be formed of a material with a relatively high friction coefficient, such as ones coated with urethane-based elastomer or urethane paint. The discharging roller 301 may be one that has its outer circumferential surface, which engages the sheet P, coated with a paint containing ceramic particles. A center shaft of the spur 302 is formed with a through-hole, into which a spur spring (not shown) as a spring shaft is inserted to give the spur 302 a contact pressure against the discharging roller 301. The spur 302 is mounted on the spur holder 303 through the spur spring (not shown).

Figure 4:
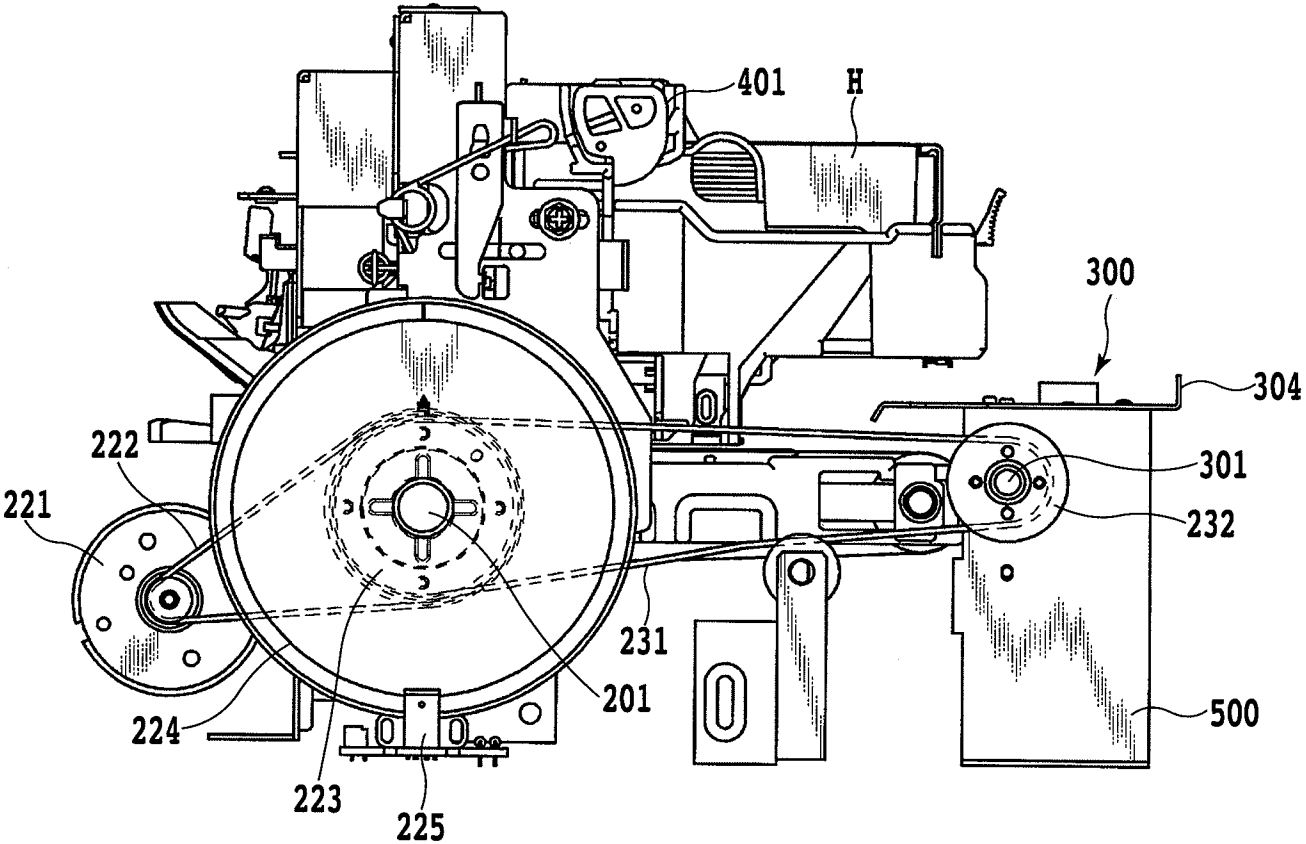
FIG. 4 is a schematic view of a drive unit for the paper conveying unit and the paper discharging unit in the printing apparatus of FIG. 1.

FIG. 4 is a schematic view of the drive unit for the paper conveying unit 200 and the paper discharging unit 300.

The drive roller 201 is driven in one direction and in opposite direction by a conveying motor 221 through a drive belt 222 and a drive roller pulley 223. So, the conveying belt 203 is rotatable in the directions of arrows A1, A2. The drive roller 201 is attached with a rotary encoder 224 for detection of a distance that it has rotated. By reading slits printed on the rotary encoder 224 with an encoder sensor 225, the drive roller 201 can be rotated a desired distance. The discharging roller 301 is rotated by the conveying motor 221 through the drive belt 222, the drive roller pulley 223, a paper discharging drive belt 231 and a paper discharging roller pulley 232.

Figure 5:
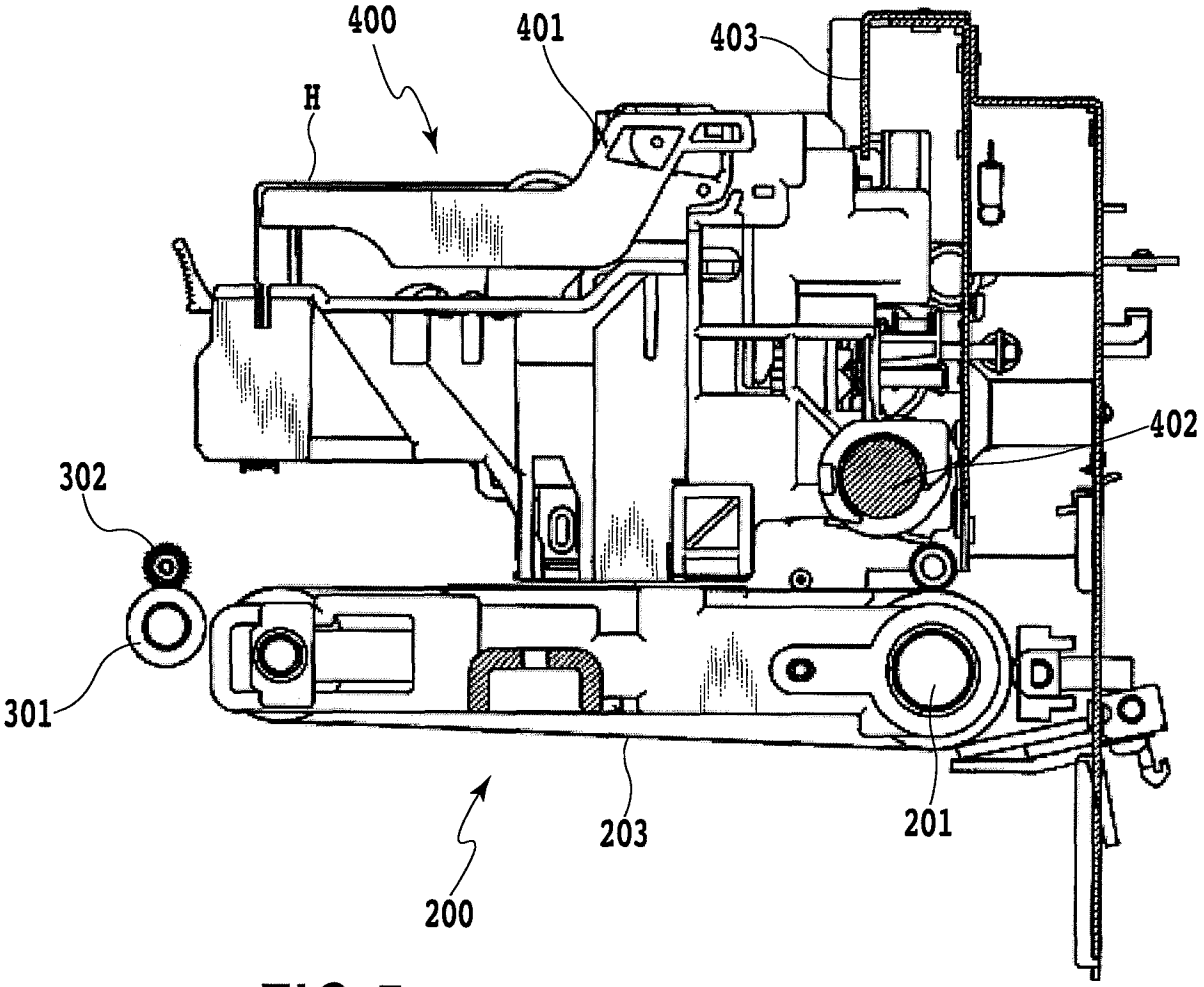
FIG. 5 is a schematic view of a carriage unit of the printing apparatus of FIG. 1.
Figure 6:
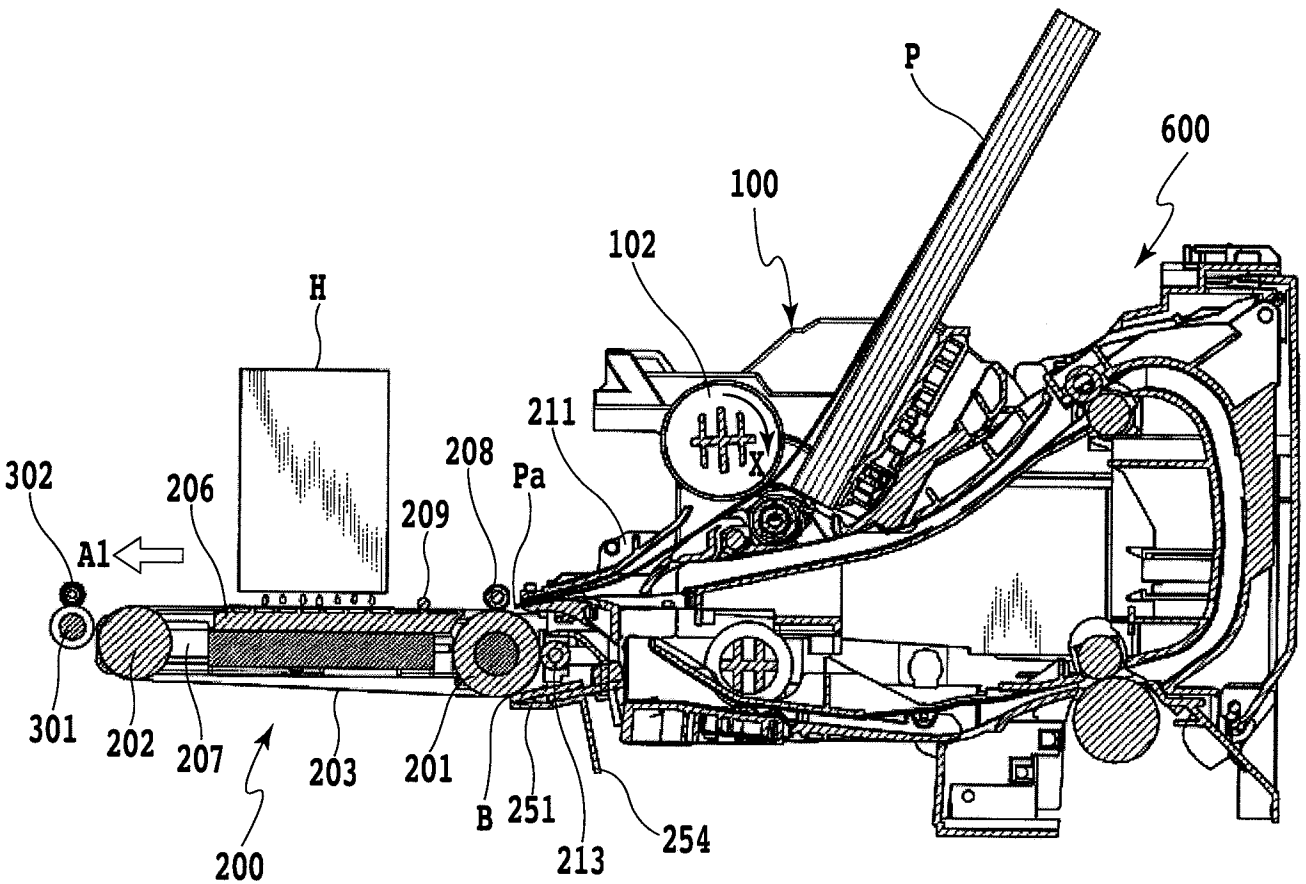
FIG. 6 is a schematic cross-sectional view of a paper conveying path in the printing apparatus of FIG. 1.

FIG. 5 is a schematic view of the carriage unit 400.

The carriage unit 400 includes a carriage 401 mounting the print head H and a drive unit for driving the carriage 401. The carriage 401 is supported by a guide shaft 402 and a guide rail 403, both incorporated into the chassis, so that it can be moved along them in the main scan direction (in a direction perpendicular to the FIG. 5 sheet) and is restricted in its rotation about the guide shaft 402 by the guide rail 403. The carriage 401 is moved in the main scan direction by a carriage motor, guided along the guide shaft 402 and the guide rail 403.

In printing an image on the sheet P, two operations are alternately repeated—an operation of ejecting ink from the print head H as the carriage 401 is moved in the main scan direction and another operation of conveying the sheet P a predetermined distance in the sub-scan direction by rotating the drive roller 201. The printed sheet P is discharged out of the printing apparatus by the discharging roller 301 and the spur 302.

Figure 12:
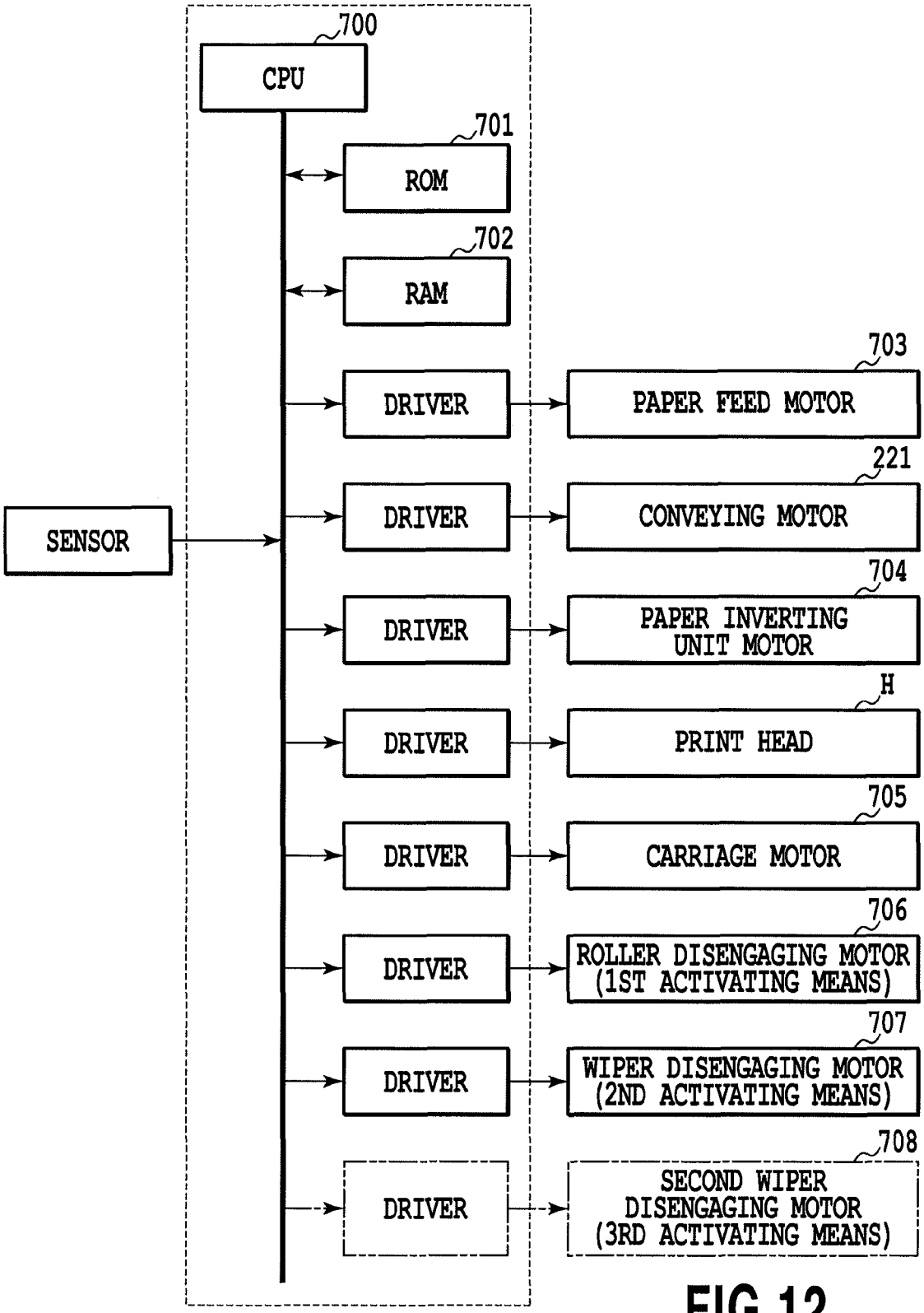
FIG. 12 is a block diagram of a control system in the printing apparatus of the first embodiment.

FIG. 12 is a block diagram of a control system in the printing apparatus of this embodiment. A CPU 700 executes control processing and data processing for the operation of the printing apparatus, both described later. A ROM 701 stores programs for these processing. A RAM 702 is used as a work area for executing these processing. The CPU 700 controls the print head H and various motors through drivers according to an input signal from a host computer, which supplies print data to the printing apparatus, and detection signals from various sensors including the encoder sensor 225. The motors to be controlled include the conveying motor 221, a paper feed motor 703 for rotating the feed roller 102, a paper inverting unit motor 704 for driving the paper inverting unit 600, and a carriage motor 705 for moving the carriage 401. They also include a roller disengaging motor 706 that constitutes a driving mechanism (first activating unit) described later and a wiper disengaging motor 707 that constitutes a pivoting mechanism (second activating unit) described later. Denoted 708 is a second wiper disengaging motor that constitutes a driving mechanism (third activating unit) in a second embodiment described later.

Next, the operation of the pinch roller 208, the electric charge removing roller 209, the electric charge supply roller 213 and the wiper 251 during printing will be explained by referring to FIGS. 6 to 9.

As the feed roller 102 is rotated in the direction of arrow X by the feed motor (not shown), the uppermost of the sheets P stacked on the pressure plate 101 is fed toward a nipping portion formed between the conveying belt 203 on the drive roller 201 and the pinch roller 208. At this time, the conveying motor 221 is at rest and the front end Pa of the sheet P thus fed abuts against the nipping portion. As the feed roller 102 is further rotated, the front end Pa of the sheet P is aligned with the nipping portion. During the paper feeding and printing operations, the pinch roller 208, the electric charge removing roller 209, the electric charge supply roller 213 and the wiper 251 are all in contact with the conveying belt 203.

Then, the conveying motor 221 is energized to rotate the conveying belt 203 in the direction of arrow A1 (first direction). This belt rotation is referred to as a "forward rotation". The sheet P is pressed against the conveying belt 203, by the pinch roller 208, already supplied with electric charges from the electric charge supply roller 213 and is held there by the electric charge attraction. The sheet P is then printed with an image by the print head H, as described earlier, as it is firmly held and carried by the conveying belt 203.

When in a marginless printing mode an image is printed by not leaving a blank margin at at least one edge of the sheet P, ink that has been ejected from the print head H to overrun that edge lands on the conveying belt 203. When the ink on the conveying belt 203 reaches the engagement portion B between the wiper 251 and the conveying belt 203, it is blocked there. Ink that has escaped being blocked by the engagement portion B remains adhered on the conveying belt 203.

Figure 7:
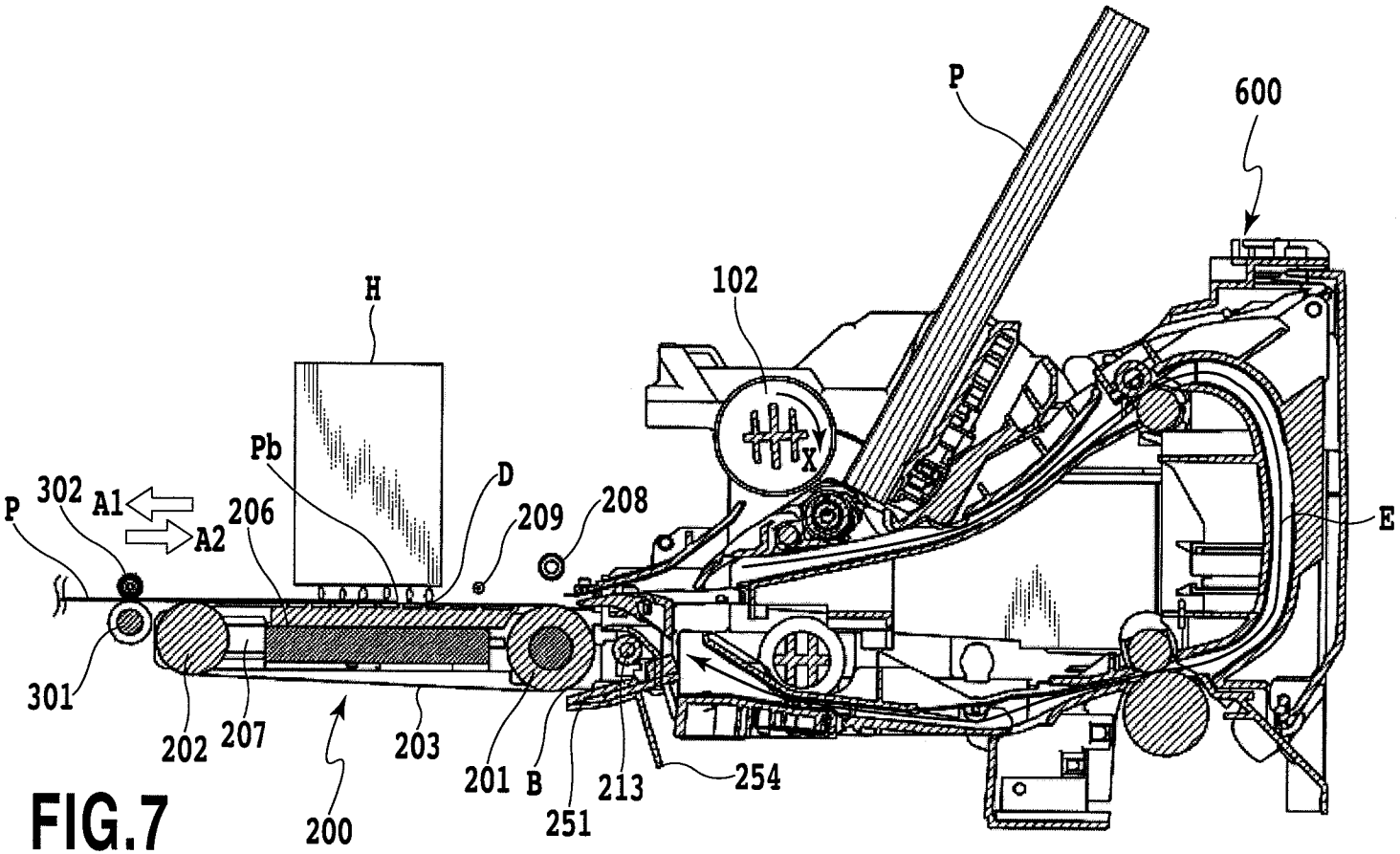
FIG. 7 is a schematic cross-sectional view of the paper conveying path in the printing apparatus of FIG. 1.

In the double-side print mode that prints the sheet P on both sides, the sheet P, after having been printed on one of its sides (referred to as a "front surface"), is pulled into the paper inverting unit 600 to print the other side (referred to as a "back surface"). That is, the conveying belt 203 holding the sheet P by the attraction of electric charges is rotated in the direction of arrow A2 (second direction) opposite the direction of arrow A1 (this operation is referred to as a "reverse rotation"), pulling the sheet P on the conveying belt 203 into the paper inverting unit 600. Before the conveying belt 203 is reverse-rotated, the pinch roller 208, the electric charge removing roller 209 and the electric charge supply roller 213 are disengaged from the conveying belt 203 by a driving mechanism (first activating unit) not shown, as shown in FIG. 7. When the following predetermined condition is met, the wiper 251 is also disengaged from the conveying belt 203 by a rotating mechanism (second activating unit) not shown.

Figure 8:
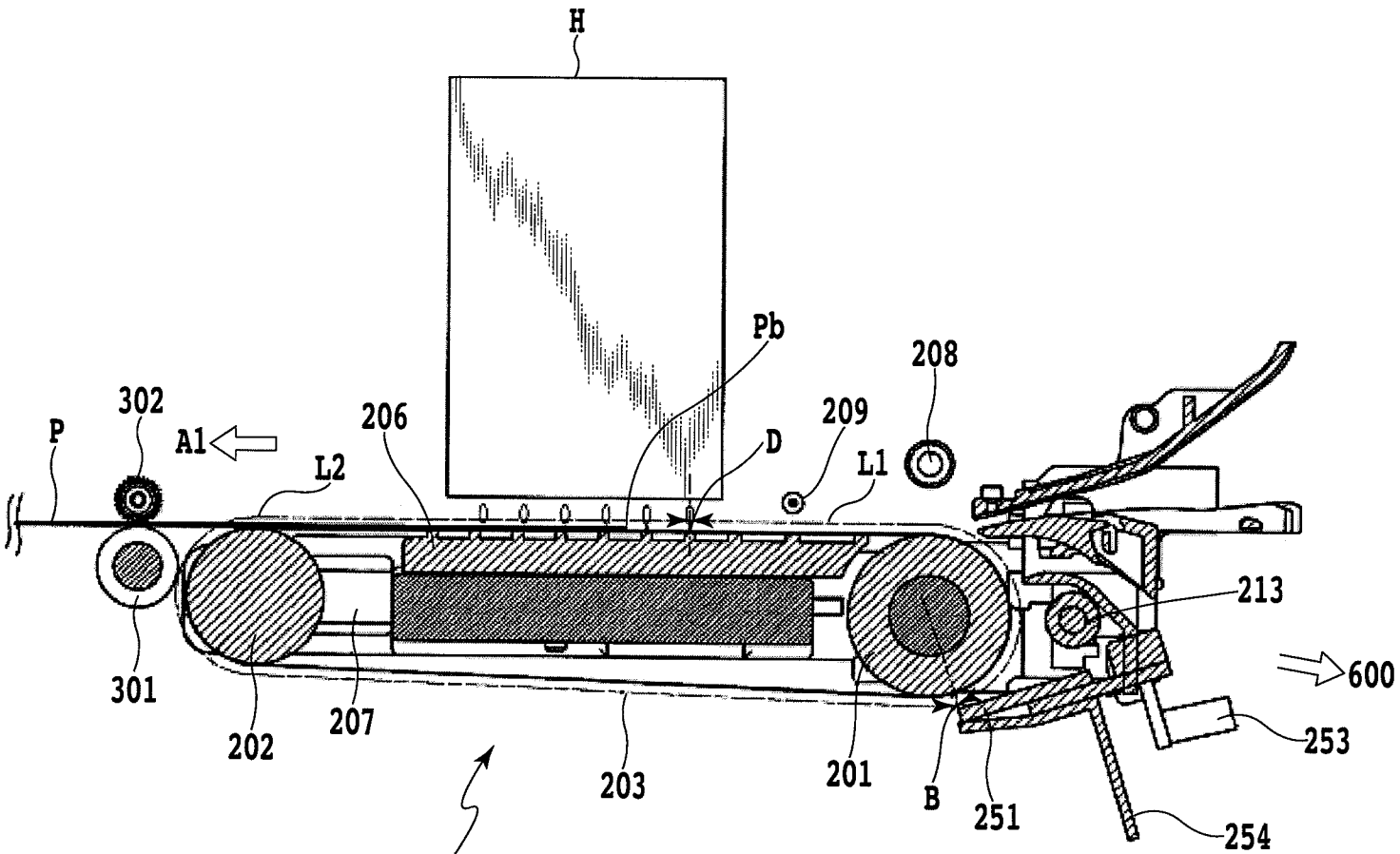
FIG. 8 is a schematic cross-sectional view of the paper conveying unit in the printing apparatus of FIG. 1.

FIG. 8 shows the state of the paper conveying unit when in the marginless printing mode the print head H has printed the last line of print data on the sheet P. Ink that has been ejected from the print head H to overrun the rear edge of the sheet P lands on the conveying belt 203. Let us consider a point in time when the last line of the print data has been printed on the sheet P. Of the positions on the conveying belt 203 at which ink has landed beyond the rear edge Pb of the sheet P, let an ink landing position most upstream in the paper conveying direction for printing (direction of arrow A1) be a position D. On the conveying belt 203, a distance from the position D through the drive roller 201 to the engagement portion B is defined as a first distance L1; and a distance from the position D through the follower roller 202 to the engagement portion B is defined as a second distance L2. The engagement portion B refers to the position at which the wiper 251 engages the conveying belt 203. The first distance L1 is equivalent to a rotating distance (fourth preset distance) that the conveying belt 203 travels in the direction of arrow A2 until the ink landing position D on the surface of the conveying belt 203 reaches where the wiper 251 is in contact with the conveying belt 203. In the double-side print mode, the distance that the conveying belt 203 needs to be reversed to pull back the sheet P into the paper inverting unit 600 after the last line of the print data has been printed on the sheet P, as shown in FIG. 8, is defined as a third distance L3. If the first distance L1 is smaller than the third distance L3, the wiper 251 is also disengaged from the conveying belt 203.

When the conveying belt 203 is reverse-operated to send the sheet P into the paper inverting unit 600, the ink adhering to the conveying belt 203 moves together with the belt. At this time, disengaging the pinch roller 208, the electric charge removing roller 209 and the electric charge supply roller 213 from the conveying belt 203 prevents the ink on the conveying belt 203 from contacting them. When the conveying belt 203 is moved in the reverse direction the third distance L3 required for the sheet P to be pulled into the paper inverting unit 600 and if the first distance L1 is smaller than the third distance L3, the ink adhesion position D on the conveying belt 203 reaches the engagement portion B between the wiper 251 and the conveying belt 203. However, by disengaging the wiper 251 from the conveying belt 203 when the first distance L1 is smaller than third distance L3, the ink on the conveying belt 203 can also be prevented from attaching to the wiper 251. That is, when the third distance L3 is greater than the first distance L1 and the conveying belt 203 is rotated more than the first distance L1 in the direction of arrow A2, i.e. when conveying belt 203 rotates more than the fourth predetermined distance, the wiper 251 is disengaged from the conveying belt 203.

The first distance L1 may also be set in connection with the rollers 208, 209, 213. For example, let the rotating distances that the conveying belt 203 needs to be moved in the direction of arrow A2 for the ink adhesion position D to come into contact with the electric charge removing roller 209, the pinch roller 208 and the electric charge supply roller 213 be L1-1, L1-2 and L1-3, respectively (third predetermined distances). If the distance L3 is L1-1≤L3<L1-2, the electric charge removing roller 209 is disengaged from the conveying belt 203. If L1-2≤L3<L1-3, the electric charge removing roller 209 and the pinch roller 208 are disengaged from the conveying belt 203. Further, if L3≥L1-3, the electric charge removing roller 209, the pinch roller 208 and the electric charge supply roller 213 are disengaged from the conveying belt 203. That is, when the conveying belt 203 is driven in the direction of arrow A2 a distance equal to or more than the third preset distances, it is possible to cause the electric charge removing roller 209, the pinch roller 208 and the electric charge supply roller 213 to part from the conveying belt 203.

Figure 13:
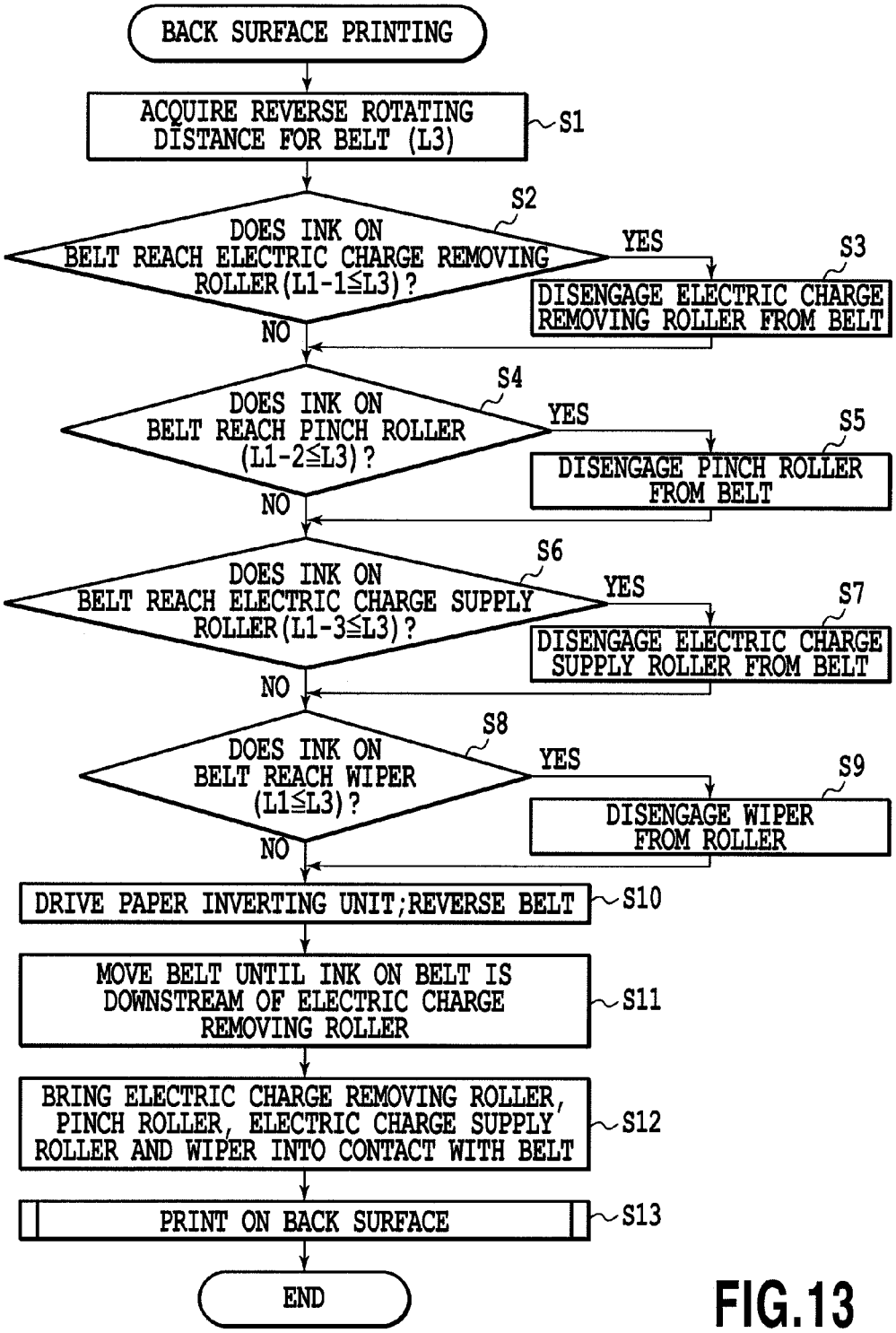
FIG. 13 is a flow chart showing a sequence of a back side printing operation in the printing apparatus of the first embodiment.

FIG. 13 is a flow chart showing a sequence of steps in the operation of the printing apparatus during the double-side print mode. First, the reverse rotation distance that the conveying belt 203 needs to be moved in the reverse direction to pull the sheet P printed with an image into the paper inverting unit 600 is acquired as the third distance L3 (step S1). Then, if the ink at the position D on the conveying belt is found to reach where the electric charge removing roller 209 is located, i.e., L1-1≤L3, then the electric charge removing roller 209 is disengaged from the conveying belt 203 (steps S2, S3). If the ink at the position D is found to reach the position of the pinch roller 208, i.e., L1-2≤L3, the pinch roller 208 is disengaged from the conveying belt 203 (steps S4, S5). If the ink at the position D is found to reach the position of the electric charge supply roller 213, i.e., L1-3≤L3, the electric charge supply roller 213 is disengaged from the conveying belt 203 (steps S6, S7). Further, if the ink at the position D is found to reach the position of the wiper 251, i.e., L1≤L3, the wiper 251 is disengaged from the conveying belt 203 (steps S8, S9). Then, the paper inverting unit 600 is operated and at the same time the conveying belt 203 is reverse-rotated (step S10).

The sheet P pulled into the paper inverting unit 600 is inverted upside down as it is driven through the unit 600 in the direction of arrow E of FIG. 7, after which it is again fed to the nipping portion between the conveying belt 203 on the drive roller 201 and the pinch roller 208. Before the inverted sheet P arrives at the nipping portion, the conveying belt 203 is driven a predetermined fourth distance L4 (fifth predetermined distance) in the paper conveying direction for printing (arrow A1). The fourth distance L4 is the distance that the conveying belt 203 needs to be rotated in order to locate the ink adhesion position D on the conveying belt 203 at a point downstream, in the arrow A1 direction, of the electric charge removing roller 209 and also of the front edge of the sheet P after being inverted (rear edge Pb before being inverted). In moving the conveying belt 203 the fourth distance L4, it may be rotated either forwardly or backwardly. That is, the conveying belt 203 is rotated the fifth predetermined distance or more in either direction so that the ink adhesion position D on the conveying belt 203 is situated downstream, in the arrow A1 direction, of the inverted sheet P delivered from the paper inverting unit 600 onto the conveying belt 203 and of the electric charge removing roller 209. As a result, the ink adhering to the conveying belt 203 is situated downstream of the electric charge removing roller 209 in the direction of arrow A1 (step S11).

If the wiper 251 is not disengaged from the conveying belt 203, the conveying belt 203 must be rotated forwardly to prevent the ink adhesion portion on the conveying belt 203 from coming into contact with that side of the wiper 251 which is opposite the ink blocking side. When the wiper 251 is disengaged from the conveying belt 203 as in this embodiment, the conveying belt 203 may be rotated in either direction—forwardly or backwardly. After the conveying belt 203 is rotated the fourth distance, the pinch roller 208, the electric charge removing roller 209, the electric charge supply roller 213 and the wiper 251 are all brought into engagement again with the conveying belt 203 (step S12). After this, as in the printing operation on the sheet P described earlier, the similar printing operation is performed on its back surface (step S13).

After the back surface of the sheet P has been printed, the conveying belt 203 is forwardly rotated a fifth distance, which is longer than a predetermined second distance L2', so as to collect all the ink adhering to the conveying belt 203 to the engagement portion B between the wiper 251 and the conveying belt 203. Let us consider a situation where the last line of the print data has been printed on the back surface of the sheet P. Of the positions on the conveying belt 203 at which ink has landed beyond the rear edge of the sheet P, let an ink landing position most upstream in the paper conveying direction for printing (direction of arrow A1) be a position D'. On the conveying belt 203, a distance from the position D' through the drive roller 201 to the engagement portion B is defined as a first distance L1' and a distance from the position D' through the follower roller 202 to the engagement portion B is defined as a second distance L2'. The conveying belt 203 is forwardly rotated the fifth distance, which is longer than the second distance L2'. The ink collected to the engagement portion B between the wiper 251 and the conveying belt 203 is led through the bridge member 254 to an ink absorbing member (not shown).

Next, an explanation will be given as to the operation associated with the reverse-rotation of the conveying belt 203 in the direction of arrow A2 when, following the printing operation, other units in the printing apparatus are operated by the driving force of the conveying motor 221. Among the other units a recovery unit (not shown) may be cited which performs a recovery operation to keep the performance of ejecting ink from the nozzle openings of the print head H in good condition. The recovery operation includes a suction-based recovery operation to suck out ink from the nozzles and discharge it into a cap, a preliminary ejection operation to eject ink not contributing to the image forming into the cap, and a wiping operation to wipe clean the ejection opening-formed surface of the print head in which nozzle openings are formed. During the suction-based recovery operation, the cap is brought into hermetic, intimate contact with the ejection opening-formed surface of the print head H and a negative pressure generated by a suction pump is introduced into the cap to draw viscous ink from the nozzles out into the cap. To operate such a recovery unit after the printing operation is finished, a driving force of the conveying motor 221 may be used. More specifically, the conveying motor 221 can be used as a drive source for the suction pump that generates a negative pressure for the suction-based recovery operation.

Figure 9:
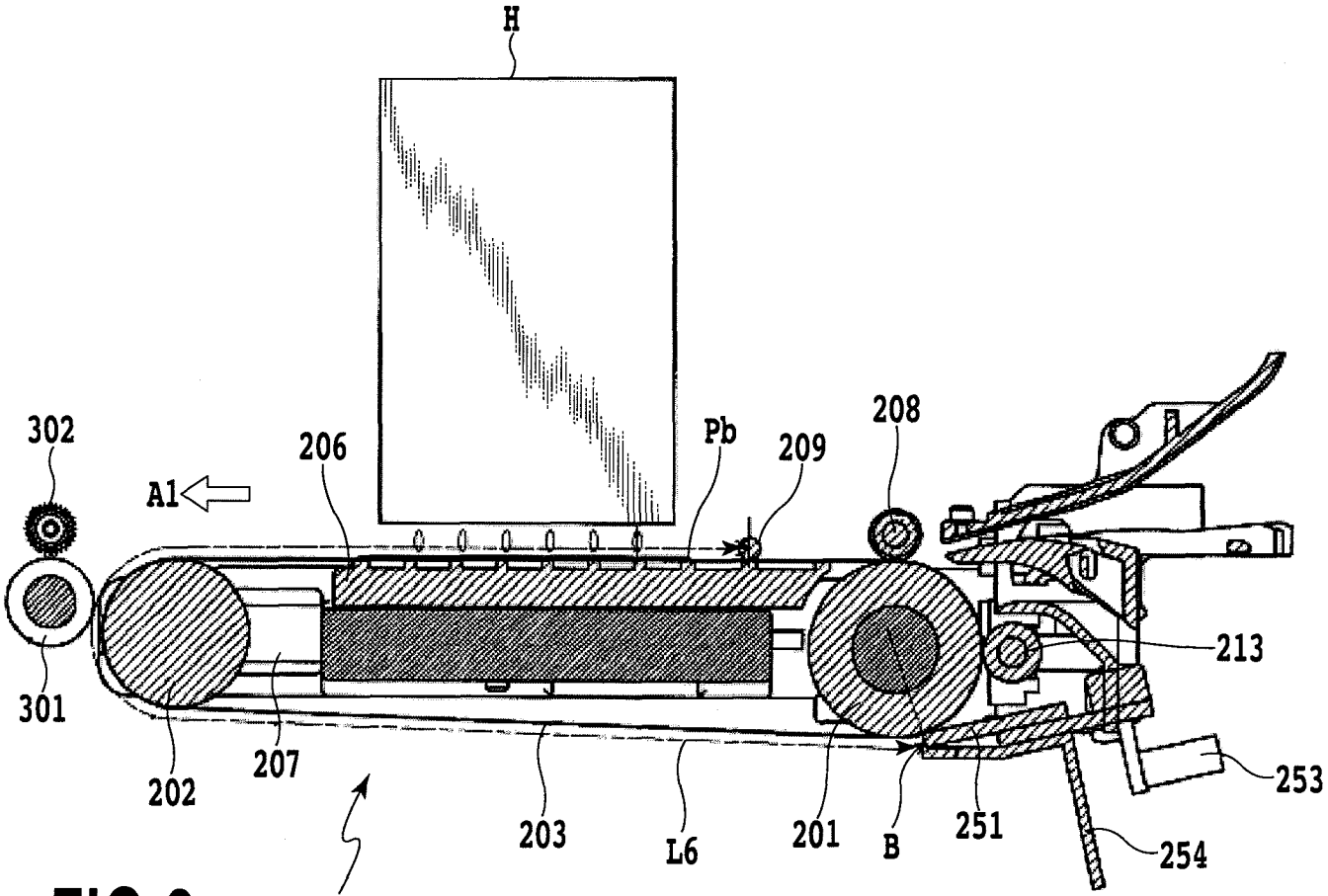
FIG. 9 is a schematic cross-sectional view of the paper conveying unit in the printing apparatus of FIG. 1.

In FIG. 9, a sixth distance L6 represents the distance along the conveying belt 203 from a first position through the follower roller 202 to a second position. The first position is where the electric charge removing roller 209 engages the conveying belt 203 and the second position is at the engagement portion B where the wiper 251 engages the conveying belt 203. So, the sixth distance L6 is equivalent to the rotating distance (first predetermined distance) that the conveying belt 203, as it is reverse-rotated, travels until the ink on the conveying belt 203 collected by the wiper 251 reaches the position of the electric charge removing roller 209. When other units in the printing apparatus (e.g., the suction pump in the recovery unit) are operated, a distance that the conveying belt 203 is moved in the reverse direction of arrow A2 is defined as a seventh distance L7. Then a comparison is made between the seventh distance L7 and the sixth distance L6.

If the sixth distance L6 is found shorter than the seventh distance L7, a cam (not shown) is activated by a drive source (not shown) to part the pinch roller 208, the electric charge removing roller 209 and the electric charge supply roller 213 from the conveying belt 203. As described above, when the conveying belt 203 rotates the first predetermined distance or more, the pinch roller 208, the electric charge removing roller 209 and the electric charge supply roller 213 are disengaged from the conveying belt 203. Then, as the conveying belt 203 is reverse-rotated, other units are activated by the conveying motor 221. If the conveying belt 203 is to be reverse-rotated one cycle or more, the wiper 251 also is disengaged from the conveying belt 203 before the other units are operated by the conveying motor 221 as the conveying belt 203 is reverse-rotated. This procedure prevents the ink at the second position B on the conveying belt 203 from sticking to the rollers 208, 209, 213 and the wiper 251.

It is also possible to set the sixth distance L6 for each of the rollers 208, 209, 213. For example, let the distances that the conveying belt 203 travels in the reverse direction of arrow A2 until that surface portion of the conveying belt 203 which was in contact with the wiper 251 comes into contact with the electric charge removing roller 209, the pinch roller 208 and the electric charge supply roller 213 be L6-1, L6-2 and L6-3, respectively. If the seventh distance L7 is L6-1≤L7<L6-2, the electric charge removing roller 209 is disengaged from the conveying belt 203. If L6-2≤L7<L6-3, the electric charge removing roller 209 and the pinch roller 208 are disengaged from the conveying belt 203. Further, if L7≥L6-3, the electric charge removing roller 209, the pinch roller 208 and the electric charge supply roller 213 are disengaged from the conveying belt 203.

Figure 14:
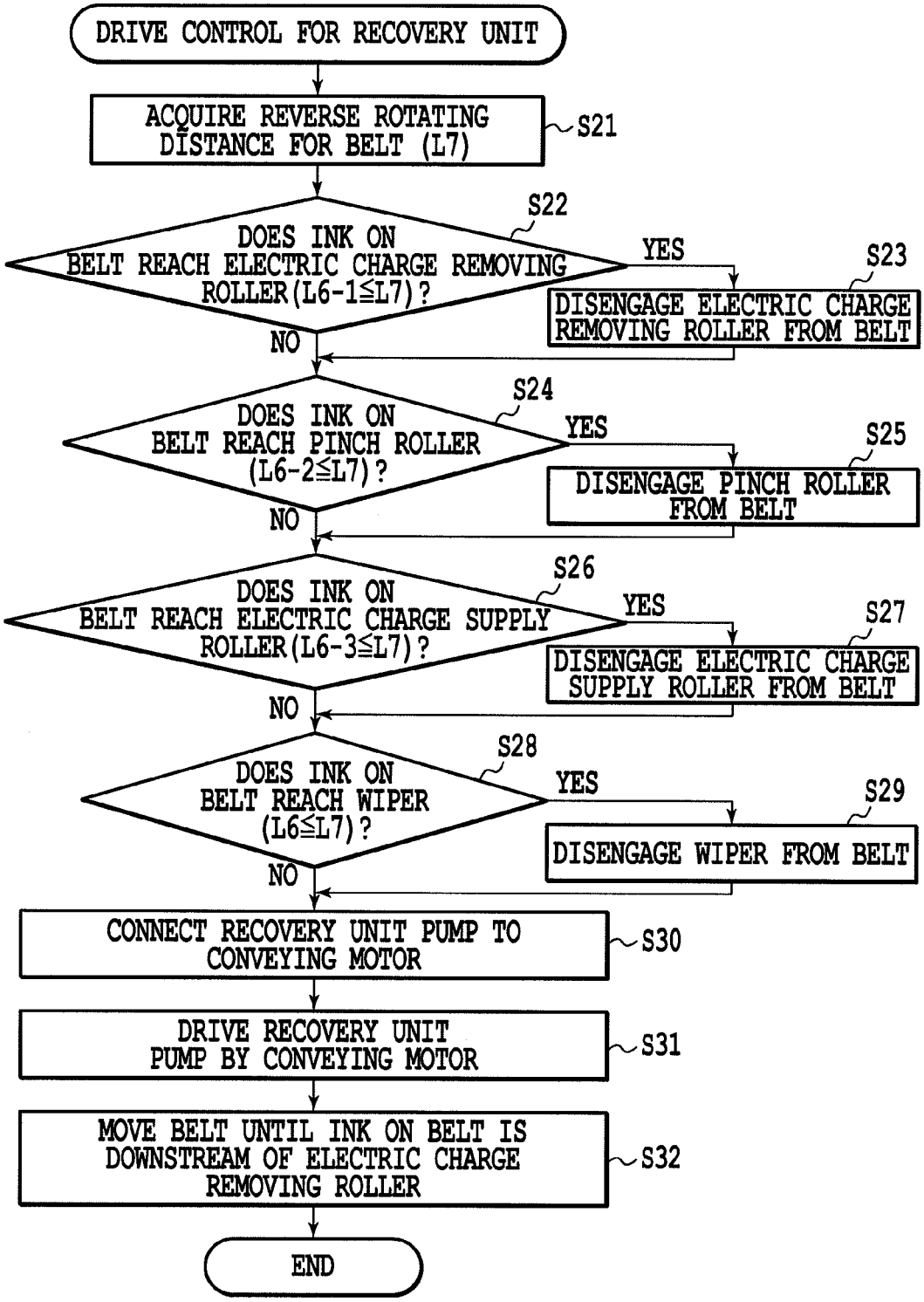
FIG. 14 is a flow chart showing a sequence of a drive control of a recovery unit following a printing operation in the printing apparatus of the first embodiment.

FIG. 14 is a flow chart showing a sequence of steps performed when other units are driven by the conveying motor 221. The following discussion concerns an example case where the suction pump in the recovery unit is operated.

Before the suction pump for the recovery unit is operated, the distance that the conveying belt 203 needs to be moved in the reverse direction of arrow A2 is acquired as the seventh distance L7 as described above (step S21). If the ink on the conveying belt 203 collected by the wiper 251 is calculated to reach the position of the electric charge removing roller 209, i.e., L6-1≤L7, the electric charge removing roller 209 is disengaged from the conveying belt 203 (steps S22, S23). If the belt adhering ink is calculated to reach the position of the pinch roller 208, i.e., L6-2≤L7, the,pinch roller 208 also is disengaged from the conveying belt 203 (steps S24, S25). Further, if the belt adhering ink is calculated to reach the position of the electric charge supply roller 213, i.e., L6-3≤L7, the electric charge supply roller 213 also is disengaged from the conveying belt 203 (steps S26, S27). Further, if the belt adhering ink is calculated to reach the position of the wiper 251, i.e., L6≤L7, the wiper 251 also is disengaged from the conveying belt 203 (steps S28, S29). Then, the paper inverting unit 600 is activated and at the same time the conveying belt 203 is reverse-rotated (step S10).

After this, the suction pump of the recovery unit is connected to the conveying motor 221 (step S30) to drive the suction pump by the conveying motor 221 (step S31). Then, the conveying belt 203 is rotated either in the arrow A1 direction or in the arrow A2 direction to move the belt adhering ink collected by the wiper 251 to a position downstream of the electric charge removing roller 209 in the direction of arrow A1 (step S32).

It is also possible to let L6-4 (second predetermined distance) to stand for a rotating distance that the conveying belt 203 travels in the reverse direction of arrow A2 until that surface portion of the conveying belt 203 which was in contact with the wiper 251 comes into contact with the wiper 251 again. In that case, if the seventh distance L7 is L7≥L6-4, i.e., if the conveying belt 203 is rotated the second predetermined distance in the reverse direction of A2, the wiper 251 can be disengaged from the conveying belt 203.

(Second Embodiment)

Figure 10:
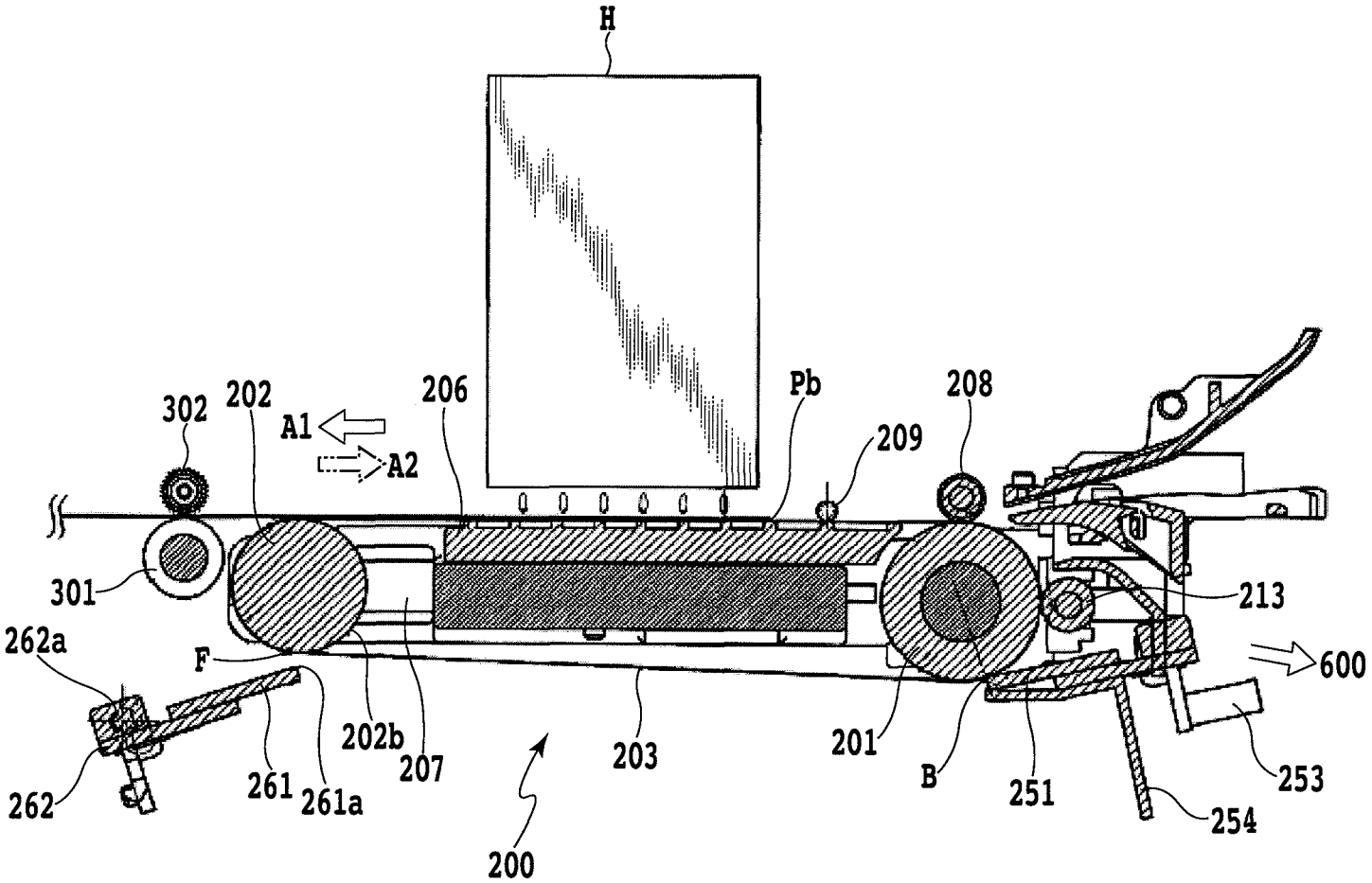
FIG. 10 is a schematic cross-sectional view of a paper conveying unit in a printing apparatus as a second embodiment of this invention.
Figure 11:
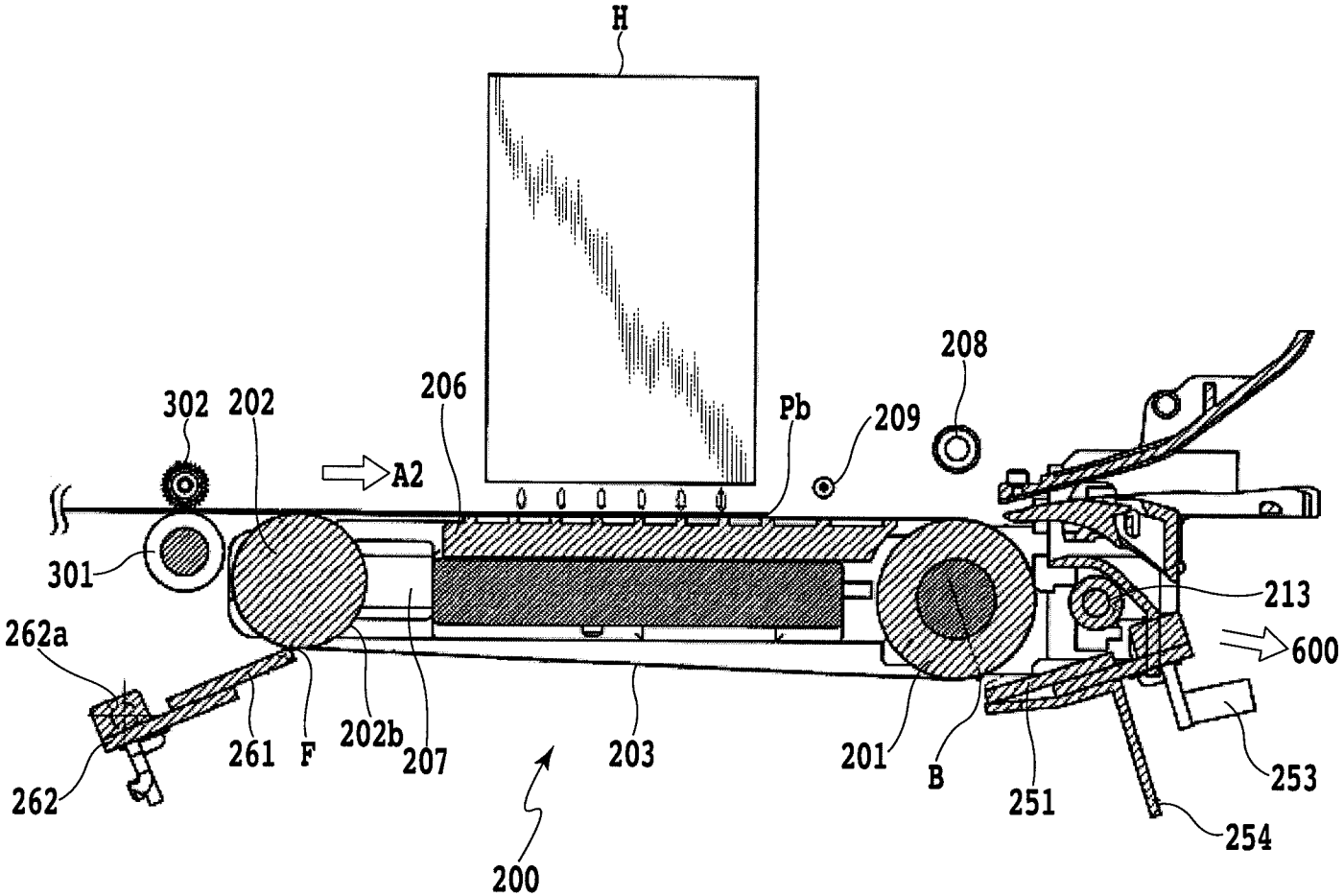
FIG. 11 is a schematic cross-sectional view of the paper conveying unit of FIG. 10 when it is reverse-operated.
Figure 15:
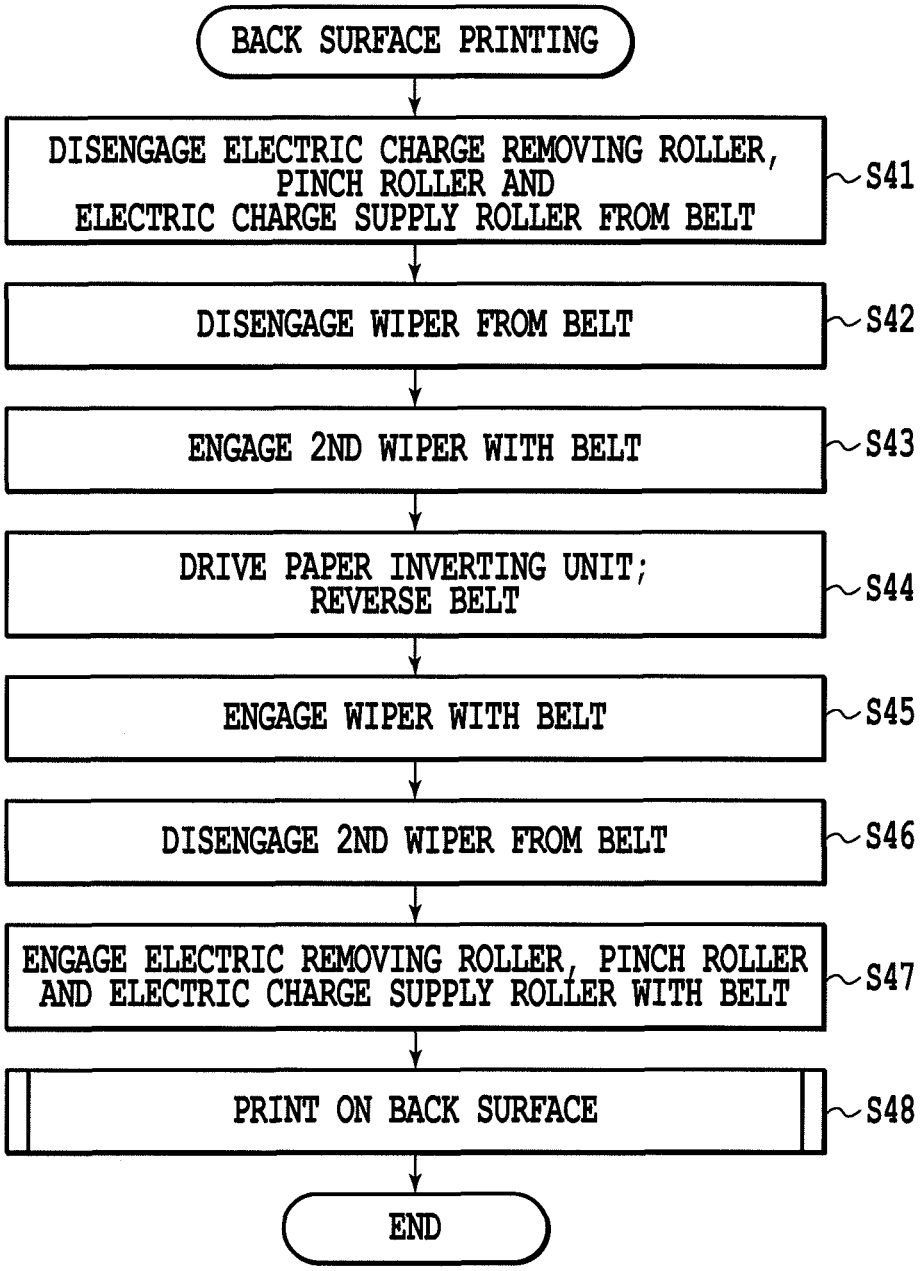
FIG. 15 is a flow chart showing a sequence of a back side printing operation in the printing apparatus of the second embodiment.

FIGS. 10 and 11 show a schematic cross-sectional view of the second embodiment of this invention. FIG. 15 is a flow chart showing a sequence of steps performed to operate the printing apparatus of this invention.

This embodiment has, in addition to the construction of the aforementioned first embodiment, a second wiper (second cleaning unit) 261 to wipe adhering ink, dirt and foreign matters off the surface of the conveying belt 203. The second wiper 261 is installed at a position facing the follower roller 202 with the conveying belt 203 in between and is brought into or out of contact with the surface of the conveying belt 203 by a driving mechanism (third activating unit).

The second wiper 261 is formed of a resilient thin plate material such as urethane rubber, plastic or elastomer and mounted on a second wiper holder 262. The second wiper holder 262 is pivotable about a pivot center 262*a*, with an edge portion 261*a* of the second wiper 261 held in contact with the surface of the conveying belt 203 whose back surface is supported on the follower roller 202. For its improved performance of removing ink, dirt and foreign matter, the second wiper 261 is preferably made to engage the conveying belt 203 in such an attitude that it resists the belt moving in the reverse direction of arrow A2. The ink on the conveying belt 203 that has been blocked and collected by the second wiper 261 accumulates at an engagement portion F between the second wiper 261 and the conveying belt 203 as the conveying belt 203 is reverse-rotated. To absorb and discharge the accumulated ink, a bridge member formed of a porous material may be provided. The second wiper 261 can be brought into or out of engagement with the conveying belt 203 by a cam (not shown) connected to a drive source (not shown). During the paper feeding or printing, the second wiper 261 is disengaged from the conveying belt 203 as shown in FIG. 10.

In the double-side print mode, the sheet P, after having been printed on its front surface, is pulled into the paper inverting unit 600 to print its back surface. As the conveying belt 203 holding the sheet P is reverse-rotated in the direction of arrow A2, the sheet P is drawn into the paper inverting unit 600. Before the conveying belt 203 is reverse-rotated, the pinch roller 208, the electric charge removing roller 209, the electric charge supply roller 213 and the wiper 251 are disengaged from the conveying belt 203 and the second wiper 261 is brought into contact with the conveying belt 203, as shown in FIG. 11. This operation corresponds to steps S41, S42, S43 in FIG. 15. This is followed by the paper inverting unit 600 being activated and the conveying belt 203 being reverse-rotated in the direction of arrow A2 (step S44). When the sheet P is pulled into the paper inverting unit 600, the ink adhering to the conveying belt 203 is moved along with the belt. Since the rollers 208, 209, 213 and the wiper 251 are disengaged from the conveying belt 203, the ink on the conveying belt 203 does not come into contact with the surfaces of the rollers 208, 209, 213 and that side of the wiper 251 which is opposite the ink blocking side. During the reverse-rotation of the conveying belt 203, the ink that has reached the engagement portion F between the second wiper 261 and the conveying belt 203 is blocked by the second wiper 261.

After the sheet P has been pulled into the paper inverting unit 600 and inverted therein until it is delivered again to the nipping portion between the drive roller 201 and the pinch roller 208, the conveying belt 203 is reverse-rotated a predetermined distance. The predetermined distance is one that the conveying belt 203 needs to be moved in the reverse direction to cause all the ink remaining on the conveying belt 203 to be situated between the engagement portion F—which is between the second wiper 261 and the conveying belt 203—and the engagement portion B—which is between the wiper 251 and the conveying belt 203. Then, the pinch roller 208, the electric charge removing roller 209, the electric charge supply roller 213 and the wiper 251, all of which have been kept out of contact with the conveying belt 203, are brought into contact again with the conveying belt 203. At the same time, the second wiper 261 is disengaged from the conveying belt 203. These operations correspond to steps S45, S46, S47 in FIG. 15. The ink on the conveying belt 203 between the engagement portion B and the engagement portion F is moved as the conveying belt 203 is forwardly rotated during the printing of the back surface of the sheet P, with the result that the belt adhering ink is blocked by the wiper 251 at the engagement portion B. The ink thus collected is led along the bridge member 254 to the ink absorbing member (not shown). Then, as in the printing operation on the front surface of the sheet P, the printing operation is performed on the back surface (back side printing) (step S48).

(Other Embodiments)

In the second embodiment described above, the second wiper 261 has been described to be formed of such thin plate materials as urethane rubber, plastics and elastomer. It may also be formed of a foamed material such as sponge capable of absorbing ink and of other ink absorbing materials. The sheets P of a print medium may be fed from a cassette provided at the bottom part of the printing apparatus as well as from the paper feeding unit 100 installed at the rear top part of the printing apparatus.

The components put in contact with the conveying belt are not limited to the pinch roller 208, the electric charge removing roller 209 and the electric charge supply roller 213 and also are not necessarily of the roller construction. The conveying belt needs only to be of a construction that is capable of conveying a print medium and thus it is not limited to the construction of the above embodiment that attracts the print medium by an electrostatic charge. For example, it may employ a construction that attracts the print medium by a vacuum suction or one on which the print medium is simply placed. Further, the printing apparatus is not limited to the serial scan type that prints images by scanning the print head in the main scan direction and may be of a full line type that prints images by holding the print head at a fixed position and continuously feeding the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-102583, filed Apr. 27, 2010, which is hereby incorporated by reference herein in its entirety.

What is claimed is:

1. A printing apparatus comprising:

a conveying belt configured to convey a print medium in a first direction and in a second direction opposite to the first direction;

a printing unit configured to perform printing by ejecting ink onto the print medium conveyed by the conveying belt in the first direction, the printing unit performing marginless printing on the print medium;

a pinching member located on the upstream side of the printing unit with respect to the first direction and configured to nip the print medium in cooperation with the conveying belt, the pinching member being movable between a first position in which the pinching member nips the print medium in cooperation with the conveying belt and a second position in which the pinching member is disengaged from the conveying belt;

a moving unit configured to move the pinching member between the first position and the second position; and a control unit configured to control the moving unit, when the print medium is conveyed a moving distance in the second direction by the conveying belt, on the basis of the moving distance of the conveying belt and a distance between an ink ejected position on the conveying belt where the ink is ejected during the marginless printing and the location of the pinching member.

2. The printing apparatus according to claim 1, wherein the pinching member is an electric charge removing roller to remove electric charges from the surface of the print medium.

3. The printing apparatus according to claim 1, wherein the pinching member is a pinch roller.

4. The printing apparatus according to claim 1, further comprising an inverting unit configured to invert the print medium that has been printed on a first surface thereof, upside down.

5. The printing apparatus according to claim 4, wherein the inverting unit is located on the upstream side of the pinching member with respect to the first direction, the print medium that has been printed on the first surface thereof being conveyed in the second direction by the conveying belt so as to be conveyed to the inverting unit.

6. The printing apparatus according to claim 1, further comprising a cleaning unit configured to remove the ink ejected onto the conveying belt.

7. A printing apparatus comprising:

a conveying belt configured to convey a print medium in a first direction and in a second direction opposite to the first direction;

a printing unit configured to perform printing by ejecting ink onto the print medium conveyed by the conveying belt in the first direction, the printing unit performing marginless printing on the print medium;

a pinching member located on the upstream side of the printing unit with respect to the first direction and configured to nip the print medium in cooperation with the conveying belt, the pinching member being movable between a first position in which the pinching member nips the print medium in cooperation with the conveying belt and a second position in which the pinching member is disengaged from the conveying belt;

a moving unit configured to move the pinching member between the first position and the second position; and a control unit configured to control the moving unit when the print medium is conveyed in the second direction by the conveying belt.

8. The printing apparatus according to claim 7, wherein the control unit controls the moving unit on the basis of a moving distance which the print medium is conveyed in the second direction.

9. The printing apparatus according to claim 8, wherein the control unit controls the moving unit to move the pinching member to the second position from the first position in a case where the moving distance is more than a distance between an ink ejected position on the conveying belt and the location of the pinching member.

10. The printing apparatus according to claim 9, wherein the control unit controls the moving unit not to move the pinching member to the second position from the first position in a case where the moving distance is less than a distance between the ink ejected position on the conveying belt and the location of the pinching member.

11. The printing apparatus according to claim 7, wherein the pinching member is an electric charge removing roller to remove electric charges from the surface of the print medium.

12. The printing apparatus according to claim 7, wherein the pinching member is a pinch roller.

13. The printing apparatus according to claim 7, further comprising an inverting unit configured to invert the print medium that has been printed on a first surface thereof, upside down.

14. The printing apparatus according to claim 13, wherein the inverting unit is located on the upstream side of the pinching member with respect to the first direction, the print medium that has been printed on the first surface thereof being conveyed in the second direction by the conveying belt so as to be conveyed to the inverting unit.

15. The printing apparatus according to claim 7, further comprising a cleaning unit configured to remove the ink ejected onto the conveying belt.

* * * * *